United States Patent [19]

Nagase

[11] 4,002,195

[45] Jan. 11, 1977

[54] MIDDLE RAIL ASSEMBLY FOR USE IN SCREEN DOORS AND SASHES

[75] Inventor: Mitsuo Nagase, Kurobe, Japan

[73] Assignee: Yoshida Kogyo K.K., Tokyo, Japan

[22] Filed: May 3, 1976

[21] Appl. No.: 682,450

[30] Foreign Application Priority Data

May 12, 1975 Japan ..... 50-63524[U]

[52] U.S. Cl. ..... 160/379

[51] Int. Cl.[2] ..... E06B 3/30

[58] Field of Search ..... 160/371, 379, 380, 383, 160/394, 397, 398, 399, 402, 403, 404; 52/311, 314, 455, 456, 457, 458, 506, 512

[56] References Cited

UNITED STATES PATENTS

| | | | |
|---|---|---|---|
| 1,135,352 | 4/1915 | Bunger | 160/398 |
| 1,635,336 | 7/1927 | Nelson | 52/455 |
| 2,042,726 | 6/1936 | Mueller | 160/394 |
| 2,395,761 | 2/1946 | Reed | 160/398 |
| 2,577,379 | 12/1951 | Spears et al. | 160/379 |
| 2,627,632 | 2/1953 | Kelly | 52/456 |

*Primary Examiner*—Peter M. Caun
*Attorney, Agent, or Firm*—Hill, Gross, Simpson, Van Santen, Steadman, Chiara & Simpson

[57] ABSTRACT

A middle rail assembly for centrally clamping a screen within a frame structure is disclosed. The middle rail includes a supporting member, a C-shaped cover and a plurality of coupling means tightly received into apertures formed in the supporting member. The coupling means are configured to be forced through the screen and fit into the apertures. The screen is therefore tightly clamped at the middle rail.

4 Claims, 3 Drawing Figures

MIDDLE RAIL ASSEMBLY FOR USE IN SCREEN DOORS AND SASHES

BACKGROUND OF THE INVENTION

1. Field of the Invention

This invention relates to screen doors and sashes, and more particularly to a middle rail assembly for centrally clamping a screen within a frame structure of such door and sash.

2. Prior Art

In prior-art screen doors or sashes, there were used woven mesh screens made of metal or plastic wires, or textile material, such screens being retained in place usually by rubber gaskets disposed along the inner periphery of a frame structure by upper and lower rails and a pair of spaced-apart vertical stiles. The screen was further held taut at a middle rail of the frame structure by similar gaskets in order to prevent the entrance of litter and insects into the building interior, which would occur if the screen were slack and thus leaky. The marginal edges of the screen were held in a groove in the middle rail by rubber gaskets, thereby permitting the screen to be clamped peripherally within the frame structure. The operation of stretching or tensioning the screen on the middle rail by such rubber gaskets was time consuming and tedious. As the rubber gaskets were exposed on the surface of the middle rail, the screen sash or door as a whole appeared unsightly. Screen doors or sashes as used with such middle rail construction were not compatible with a single-expanse screen but only with a two-piece screen, one of the latter being clamped between the top rail and the middle rail, and the other disposed between the middle rail and the bottom rail.

SUMMARY OF THE INVENTION

With the above noted prior-art difficulties in view, it is the primary object of the invention to provide a middle rail assembly for tensioning a screen within a frame structure with greater ease.

Another object of the invention is to provide a middle rail assembly which hides screen tensioning means from external view so as to render the entire screen door or sash to be neat and aesthetic in appearance.

Still another object of the invention is to provide a middle rail assembly which enables the installation of a single-expanse screen.

Briefly stated, a middle rail assembly includes a supporting member held horizontally between a pair of stiles. One side of the supporting member facing a screen has a plurality of apertures. The assembly further includes a middle rail cover having a transversally extending channel along the entire length thereof for slidably receiving a plurality of adjusting plates. Each adjusting plate is provided with a coupling means configured to be forced through the screen and into the apertures of the supporting member to thereby clamp or tension the screen within the frame structure and to retain the middle rail cover in its place.

Other objects and advantages of the invention will become more apparent from the following description when read in conjunction with the accompanying drawings in which like reference numerals denote like parts throughout the several views.

DESCRIPTION OF THE PREFERRED EMBODIMENT

Figure 1:
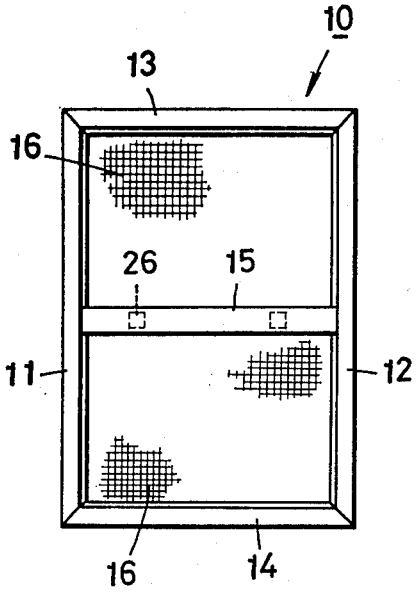
FIG. 1 is a elevational view of a screen sash provided with a middle rail assembly embodying the invention.

In FIG. 1 is shown a screen sash 10 which generally includes a pair of vertical stiles 11, 12, between which extend a top rail 13, a bottom rail 14, and a middle rail 15, to thereby form a frame structure of the sash 10, within which a woven mesh screen 16 of metal or plastic wire, or textile material, is supported. The marginal edges of the screen 16 are held and retained by a strip of rubber gasket 17. The gasket 17 together with the marginal edges of the screen 16 is tightly received into a slit 18 formed along the outer surface of each of the vertical stiles 11, 12, the top rail 13, and the bottom rail 14. The confronting inner surfaces of the stiles 11, 12 are each provided with a groove 19 extending substantially along the entire length of each stile, and which receive and hold the lateral ends of a supporting member 20 of the middle rail 15, so as to enable the member 20 to be tightly held horizontally between the stiles 11, 12. The supporting member 20 is made of extruded steel has a hollow rectangular cross-section along its entire length. The exterior surface of the supporting member 20 facing the screen 16 has a plurality of apertures 21 spaced apart at suitable intervals along the entire length of the member 20.

A middle rail cover 22 of C-shaped cross-section defines a transversely extending channel 23 along its entire length, there being a pair of opposed flanges 24, 25 extending the entire length of the cover. A plurality of adjusting plates 26, substantially rectangular in cross-section and each provided with a coupling member 27, is slidably received into the channel 23 of the middle rail cover 22. The base of the adjusting plate is substantially complementary in cross-section to the channel 23. The coupling member 27 includes a neck 28 and a spear-headed end 29. The neck 28 has a length substantially equal to the total thickness of the screen 16 and the apertured side of the supporting member 20. The spear-headed end 29 of the coupling is shorter than the width of the hollow interior of the supporting member 20.

The coupling member 27 is made of plastic or any other suitable resilient material.

Figure 3:
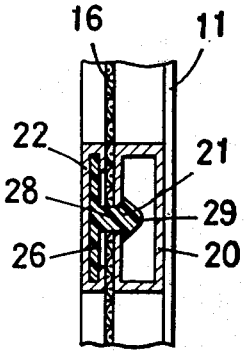
FIG. 3 is a vertical cross-sectional view of the middle rail assembly in its assembled state.
Figure 2:
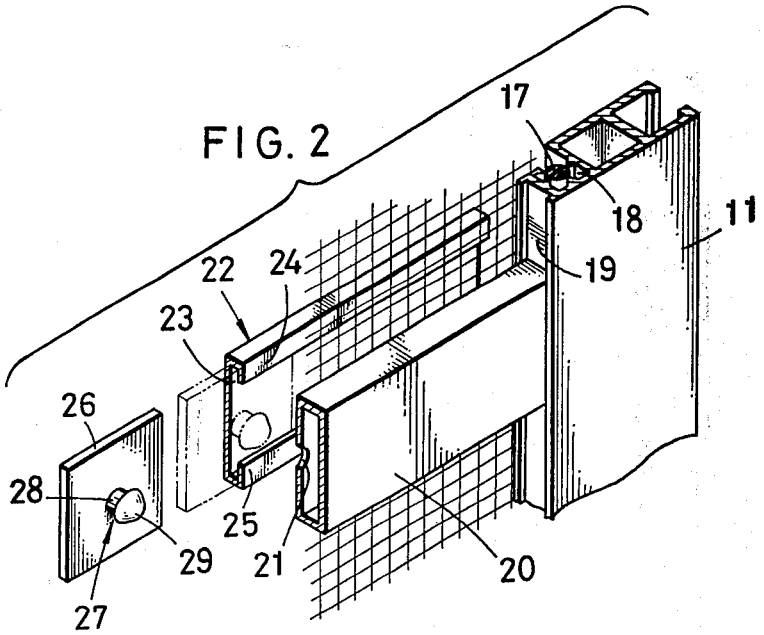
FIG. 2 is an enlarged perspective view of a fragmentary portion of the middle rail assembly of FIG. 1, partly exploded, and shown as attached to a vertical stile of the sash.

As shown in FIGS. 2 and 3, the adjusting plate 26 bearing the coupling member 27 is first slidably inserted into the channel 23 from a longitudinal end thereof such that the coupling member 27 projects inwardly through a space defined by the flanges 24, 25. The plate is slidably brought to register with the aperture 21 in the supporting member 20. To be more specific, the adjusting plate 26 is slid until the coupling member 27 registers with the aperture 21. Thereafter, the middle rail cover 22 holding the adjusting plates 26 within its channel 23 is pressed laterally toward the supporting member 20 until the spear-headed end 29 of the coupling 27 is forced through the screen 16 and snugly fits into the aperture 21 of the supporting member 20. The screen 16 is therefore tightly sandwiched or clamped between the middle rail cover 22 and the supporting member 20 and thereby is firmly clamped expanded within the frame structure. The flanges 24, 25 and the coupling member 27 which is forced into the apertures 21 cooperate to tightly retain the middle rail cover 22 from any accidental detachment from the supporting member 20.

As the middle rail cover 22 hides the coupling 27 from external view, the entire screen sash is rendered aesthetic in appearance. With the above middle rail construction, the use of a single expanse screen is made possible, and the central clamping of the screen is reduced to only two manual steps, namely aligning the coupling member 27 with the apertures 21, and laterally forcing the members through the screen and into the apertures 21. Furthermore, as the adjusting plates 26 are slidably movable within the channel 23 of the middle rail cover 22, apertures 21 can be bored at any desired position along the length of the supporting member 20.

Although a particular preferred embodiment of the invention has been disclosed in detail for illustrative purposes, it will be understood that various changes and modifications may be made without departing from the scope and spirit of the appended claims.

I claim as my invention:

1. A middle rail assembly for centrally clamping the screen in the frame of a screen door or sash, comprising:

a. a supporting member adapted to be held at its ends by the frame and having a plurality of apertures in a side thereof for being directed toward one side of the screen;

b. a middle rail cover having a C-shaped cross-section defining a channel extending along its length and opening toward the other side of the screen along the length of said supporting member;

c. a plurality of adjusting plates slidably snugly disposed in said channel; and d. coupling means projecting from each of said adjusting plates, said means being of such configuration as to enable it to be forced through the screen and tightly into one said apertures for thereby clamping the screen therebetween.

2. A middle rail assembly according to claim 1, said supporting memberbeing extruded metal having a hollow rectangular cross-section.

3. A middle rail assembly according to claim 2, said coupling means including:

a. neck having a length substantially the same as the combined thickness of said screen and said apertured side of said supporting member; and b. a spear-headed end on said neck, said spear-headed end having a length shorter than the width of the hollow interior of said supporting member.

4. A middle rail assembly according to claim 1, having a combination therewith:

a. a pair of vertical stiles, a top rail and a bottom rail joined together as a rectangular frame, said vertical stiles supporting the ends of said supporting member; and b. a rectangular screen secured at its periphery to said rectangular frame and centrally clamped between said supporting member and said rail cover, and through which said coupling means extend.

* * * * *